United States Patent [19]

Mabe et al.

[11] Patent Number: 4,673,340

[45] Date of Patent: Jun. 16, 1987

[54] VARIABLE CAPACITY SCROLL TYPE FLUID COMPRESSOR

[75] Inventors: Atsushi Mabe, Isesaki; Masami Negishi, Takasaki, both of Japan

[73] Assignee: Sanden Corporation, Gunma, Japan

[21] Appl. No.: 865,594

[22] Filed: May 22, 1986

Related U.S. Application Data

[63] Continuation of Ser. No. 690,201, Jan. 10, 1985, abandoned.

[51] Int. Cl.[4] ..... F04C 18/04; F04C 29/08

[52] U.S. Cl. ..... 418/15; 418/55

[58] Field of Search ..... 418/15, 55; 417/440

[56] References Cited

U.S. PATENT DOCUMENTS

| | | | |
|---|---|---|---|
| 4,383,805 | 5/1983 | Teegarden et al. | 418/55 |
| 4,468,178 | 8/1984 | Hiraga et al. | 417/440 |
| 4,496,296 | 1/1985 | Arai et al. | 418/55 |

FOREIGN PATENT DOCUMENTS

| | | | |
|---|---|---|---|
| 57-153984 | 9/1982 | Japan | 418/15 |

*Primary Examiner*—John J. Vrablik

*Attorney, Agent, or Firm*—Banner, Birch, McKie & Beckett

[57] ABSTRACT

A scroll type fluid compressor with a capacity adjusting mechanism is disclosed. The compressor includes a housing, a first fluid inlet port, a second fluid inlet port and a fluid outlet port. A fixed scroll member is disposed within the housing and has a circular end plate from which a first wrap extends. The end plate of the fixed scroll member partitions the inner chamber of the housing into a front chamber and a rear chamber. The rear chamber is divided into a discharge chamber connected to the fluid outlet port, a first suction chamber connected to the first fluid inlet port and a second suction chamber connected to the second fluid inlet port. An orbiting scroll member is disposed in the front chamber and also has a circular end plate from which a second wrap extends. Both wraps interfit at angular and radial offsets to form a plurality of line contacts to define at least one pair of sealed off fluid pockets. The end plate of the fixed scroll member has a hole at an outer peripheral portion thereof which connects the first suction chamber to the front chamber. The end plate also has a pair of holes which are placed at symmetrical positions and which connect the fluid pockets to the second suction chamber. Valve means is disposed in the communication line between the external fluid circuit and the connecting line of the first and second inlet ports to sectively control the connection therebetween.

9 Claims, 3 Drawing Figures

VARIABLE CAPACITY SCROLL TYPE FLUID COMPRESSOR

This application is a continuation of application Ser. No. 690,201, filed Jan. 10, 1985, abandoned.

BACKGROUND OF THE INVENTION

The present invention relates generally to the field of fluid displacement apparatus, and more particularly, is directed to a scroll type fluid compressor having a variable capacity control mechanism.

Scroll type fluid displacement apparatus are well known in the prior art. For example, U.S. Pat. No. 801,182 issued to Creux discloses such a device which includes two scrolls each having a circular end plate and a spiroidal or involute spiral element. The scrolls are maintained angularly and radially offset so that both spiral elements interfit to make a plurality of line contacts between their spiral curved surfaces to thereby seal off and define at least one pair of fluid pockets. The relative orbital motion of the two scrolls shifts the line contacts along the spiral curved surfaces and, as a result, the volume of the fluid pockets changes. Since the volume of the fluid pockets increases or decreases dependent on the direction of the orbital motion, a scroll type fluid displacement apparatus may be used to compress, expand or pump fluids.

Scroll type fluid displacement apparatus are suitable for use as refrigerant compressors in air conditioners. In this application, thermal control in a room or control of the air conditioner is generally accomplished by intermittent operation of the compressor. Once the temperature in the room has been cooled to a desired temperature, the supplemental refrigerant capacity required of the air conditioner to maintain the room at the desired temperature need not be very large. Prior art air conditioners do not have capacity control mechanisms and therefore, supplemental cooling is provided by intermittent operation of the compressor. Thus, the relatively large load which is required to drive the compressor is intermittently applied to the driving source.

Prior art scroll type compressors which are used in automotive air conditioners are driven by the automobile through an electromagnetic clutch. Once the passenger compartment reaches the desired temperature, supplemental cooling is also accomplished by intermittent operation of the compressor through the electromagnetic clutch. Thus, the relatively large load which is required to drive the compressor is intermittently applied to the automobile engine.

It is, therefore, desirable to provide a scroll type compressor with a displacement or volume adjusting mechanism which controls compressor capacity as occasion demands, thus eliminating the need for intermittent operation of the compressor and the accompanying stress on the driving source and electromagnetic clutch. In a scroll type compressor, adjustment of capacity can be easily accomplished by controlling the volume of the sealed off fluid pockets. Such a capacity adjusting mechanism is disclosed in U.S. Pat. No. 4,468,178 issued to Hiraga et al. In the Hiraga et al. patent, the adjusting mechanism includes a pair of holes formed through the circular end plates of one of the scrolls. The holes are symmetrically placed so that the wrap of the other scroll simultaneously crosses over the holes. The opening and closing of the holes is controlled by valves.

In the Hiraga capacity adjusting mechanism, when the pair of holes is opened to effect a reduction in compressor capacity, fluid in the outer most fluid pockets is permitted to leak to the suction chamber through the holes. As fluid passes through the holes, there is a corresponding pressure increase in the suction chamber and a pressure loss in the outer most fluid pockets. As a result, the compressor capacity is not efficiently reduced. One proposed solution to this problem is to increase the number of holes formed in the circular end plate of one of the scrolls or to increase the diameter of the holes in order to enable easier flow of the passing fluid. It has been found, however, that such a solution is difficult to implement in practice and even further reduces the operating efficiency of the compressor.

SUMMARY OF THE INVENTION

It is, therefore, the overall object of the present invention to provide an improved scroll type variable capacitor compressor.

It is a specific object of the present invention to provide an improved scroll type variable capacity compressor which incorporates a mechanism for changing the capacity of the compressor as occasion demands without a significant loss in operating efficiency.

It is another specific object of the present invention to provide an improved scroll type variable capacity compressor which is simple in construction and which can be readily and reliably manufactured.

The present invention satisfies these and other objects by providing a scroll type compressor which includes a pair of scrolls, each of which has an end plate and a wrap extending from a side surface of the end plate. The wraps interfit at an angular and radial offset to make a plurality of line contacts to define at least one pair of sealed off fluid pockets. A driving mechanism is operatively connected to one of the scrolls to effect the orbital motion of the scroll by the rotation of a drive shaft while the other scroll remains fixed or stationary. The driven or orbiting scroll is prevented from rotation by a rotation preventing means. Therefore, the fluid pockets shift along the spiral curved surface of the wrap, which changes the volume of the fluid pockets. A hole is formed through the end plate of one of the scrolls to form a first fluid communication channel between a suction chamber in the compressor and a fluid inlet port. A pair of holes is also formed through the end plate of one scroll to form a second fluid communication channel between the pair of fluid pockets and the fluid inlet port. The pair of fluid pockets are located symmetrically along the wrap so that the facing wrap simultaneously crosses over both of the pair of holes. Valve means selectively controls the opening and closing of the first and second fluid communication channels.

Further objects, features and other aspects of this invention will be undestood from the detailed description of the preferred embodiment of the invention with reference to the annexed drawings.

DETAILED DESCRIPTION OF THE PREFERRED EMBODIMENT

Figure 1:
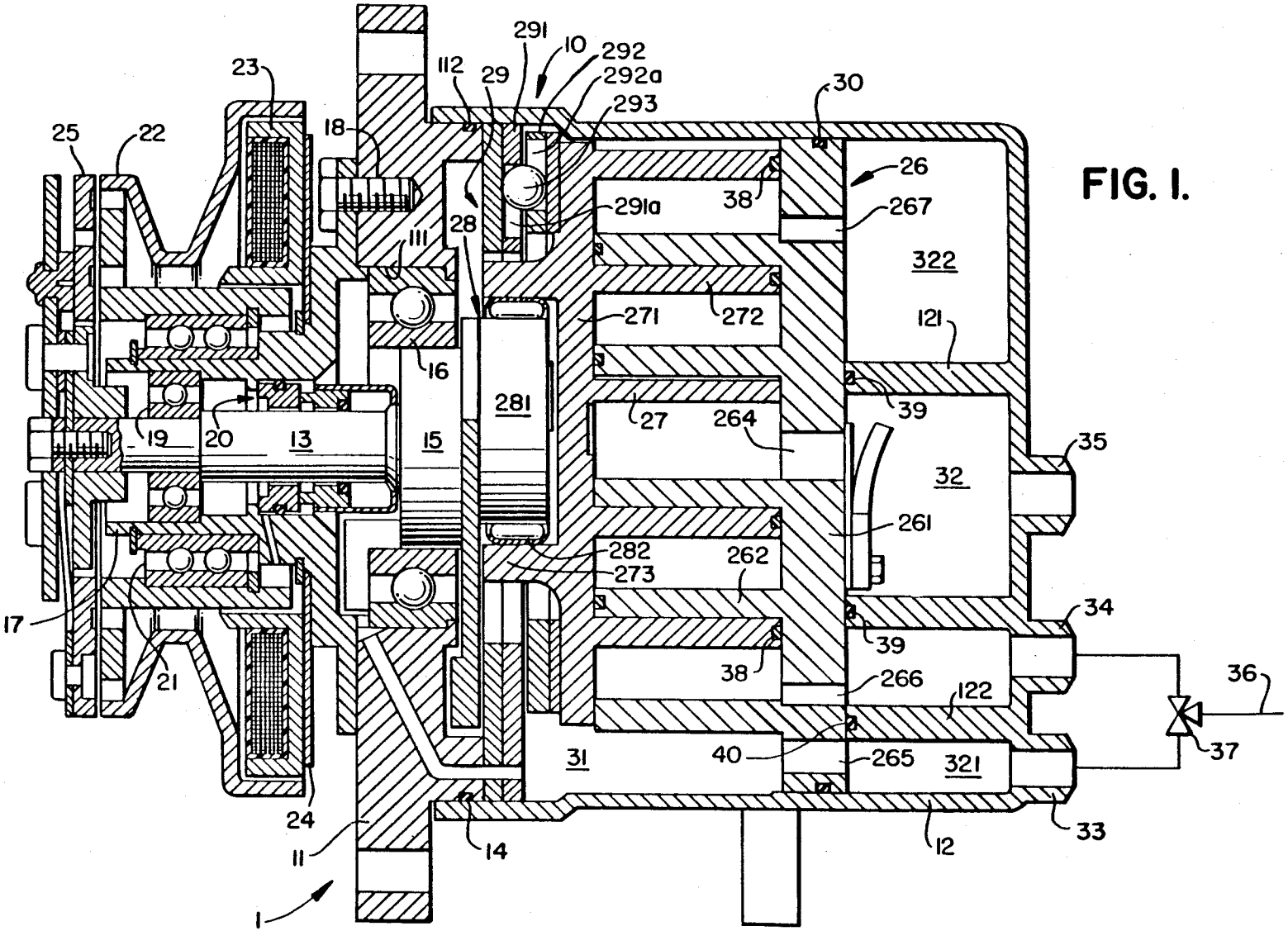
FIG. 1 is a vertical cross-sectional view of a scroll type compressor in accordance with one embodiment of the present invention.

With reference to FIG. 1, refrigerant compressor 1 is shown in accordance with one embodiment of the present invention. Compressor 1 includes housing 10 having front end plate 11 which is made of aluminum or aluminum alloy and cup shaped casing 12 which is attached to an end surface of front end plate 11. Opening 111 is formed in the center of front end plate 11 for penetration or passage of drive shaft 13. Annular projection 112 is formed on a rear end surface of front end plate 11. Annular projection 112 faces cup shaped casing 12 and is concentric with opening 111. An outer peripheral surface of annular projection 112 extends into an inner wall of the opening of cup shaped casing 12. Thus, cup shaped casing 12 is covered by front end plate 11. O-ring 14 is placed between the outer peripheral surface of annular projection 112 and the inner wall of the opening of cup shaped casing 12 to seal the mating surfaces of front end plate 11 and cup shaped casing 12.

Annular sleeve 17 projects from the front end surface of front end plate 11 and surrounds drive shaft 13 to define a shaft seal cavity. In the embodiment shown in FIG. 1, sleeve 17 is separate from front end plate 11 and is fixed to the front end surface of front end plate 11 by screws 18. An O-ring is placed between the end surface of fron end plate 11 and the end surface of sleeve 17 to seal the mating surfaces of front end plate 11 and sleeve 17. Alternatively, sleeve 17 may be formed integral with front end plate 11.

Drive shaft 13 is rotatably supported by sleeve 17 through bearing 19 located within the front end of sleeve 17. Drive shaft 13 has disk 15 at its inner end which is rotatably supported by front end plate 11 through bearing 16 located within opening 111 of front end plate 11. Shaft seal assembly 20 is coupled to drive shaft 13 within the shaft seal cavity of sleeve 17.

Pulley 22 is rotatably supported by bearing 21 which is carried on the outer surface of sleeve 17. Electromagnetic coil 23 is fixed about the outer surface of sleeve 17 by support plate 24 and is received in an annular cavity of pulley 22. Armature plate 25 is elastically supported on the outer end of drive shaft 13 which extends from sleeve 17. Pulley 22, electromagnetic coil 23 and armature plate 25 form a magnetic clutch. In operation, drive shaft 13 is driven by an external power source, for example the engine of an automobile, through a rotation transmitting device such as the above described electromagnetic clutch.

The inner wall of cup shaped casing 12 and the rear end surface of front end plate 11 forms a chamber which includes fixed scroll 26, orbiting scroll 27, driving mechanism 28 for orbiting scroll 27 and a rotation preventing/thrust bearing device 29 for orbiting scroll 27.

Fixed scroll 26 includes circular end plate 261 and wrap or spiral element 262 affixed to or extending from a side surface of end plate 261. Fixed scroll 26 is secured in casing 12 by suitable fastening devices (not shown). Circular end plate 261 of fixed scroll 26 partitions the inner chamber of cup shaped casing 12 into first chamber 31 and second chamber 32. Seal ring 30 is disposed within a circumferential groove of circular end plate 261 to form a seal between the inner wall of cup shaped casing 12 and the outer wall of circular end plate 261. Spiral element 262 of fixed scroll 26 is located within first chamber 31.

Orbiting scroll 27, which is located in first chamber 31, includes circular end plate 271 and wrap or spiral element 272 affixed to or extending from a side surface of end plate 271. Spiral elements 262 and 272 interfit at an angular offset of 180° at a predetermined radial offset. The spiral elements define at least one pair of sealed off fluid pockets between their interfitting surfaces.

Driving mechanism 28, which is operatively connected to orbiting scroll 27, includes bushing 281 by which orbiting scroll 27 is rotatably supported through bearing 282. Bearing 282 is placed between the outer peripheral surface of bushing 281 and boss 273 which axially projects from the outer end surface of circular end plate 271 of orbiting scroll 27. Bushing 281 is connected to an inner end of disk 15 at a point radially offset or eccentric of the axis of drive shaft 13.

Rotation preventing/thrust bearing device 29 is placed between the inner end surface of front end plate 11 and the end surface of end plate 271 which faces the inner end surface of front end plate 11. Rotation preventing/thrust bearing device 29 includes fixed ring 291 attached to the inner end surface of front end plate member 11, orbiting ring 292 attached to the end surface of end plate 271 and a plurality of bearing elements, such as balls 293, placed between pockets **291*a* and 292*a* formed through rings 291 and 292. The rotation of orbiting scroll 27 during its orbital motion is prevented by the interaction of balls 293 with rings 291, 292. The axial thrust load from orbiting scroll 27 is supported on front end plate 11 through balls 293**.

Cup shaped casing 12 is provided with partition walls 121 and 122 axially projecting from the inner surface thereof to separate rear chamber 322 from discharge chamber 323. The axial end surface of each partition wall contacts against a rear end surface of circular end plate 261. Seal rings 39 and 40 are located on the axial end surface of each of partition walls 121 and 122 to seal the matching surfaces of casing 12 and end plate 271 of orbiting scroll 27. Cup shaped casing 12 has a first inlet port 33 for connecting first suction chamber 321 to an external fluid circuit, second inlet port 34 for connecting second suction chamber 322 to an external fluid circuit and fluid outlet port 35 for connecting discharge chamber 323 to an external fluid circuit. First and second inlet ports 33 and 34 are connected to suction line 36 of the fluid circuit through three-way valve device 37.

Figure 2:
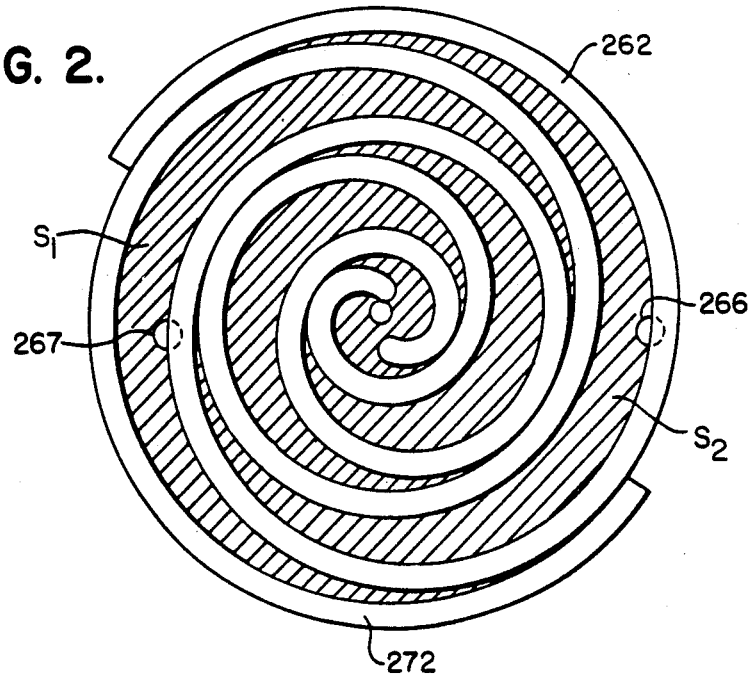
FIGS. 2–3 are schematic views illustrating the operation of the capacity adjusting mechanism of the present invention.
Figure 3:
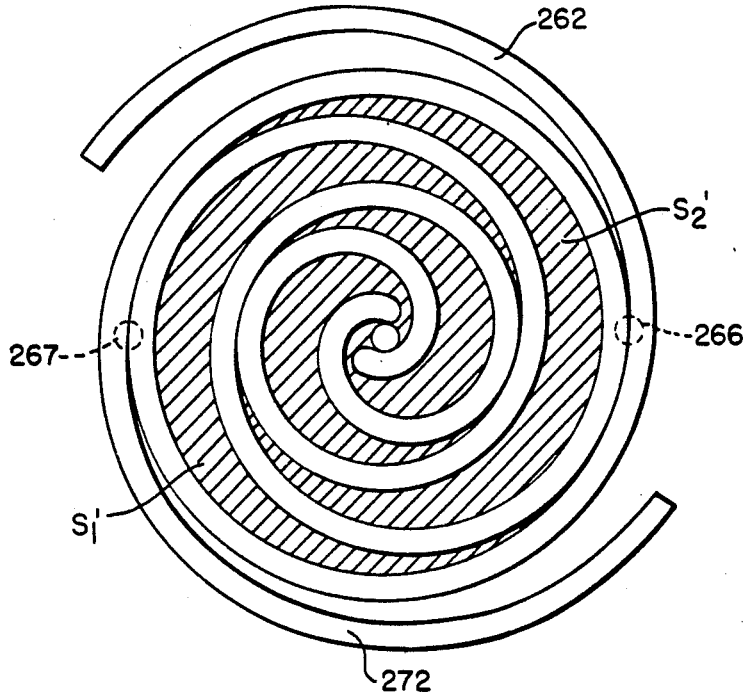

Circular end plate 261 of fixed scroll 26 has discharge hole 264 located at a position near the center of spiral element 262 which communicates between the fluid pocket in the center position of the spiral elements and discharge chamber 323. Circular end plate 261 also has suction hole 265 at an outer peripheral portion thereof which communicates between first chamber 31 and first suction chamber 321. Circular end plate 261 of fixed scroll 26 also has a pair of holes 266 and 267 which are placed at symmetrical positions so that the axial end surface of spiral element 272 of orbiting scroll 27 simultaneously crosses over holes 266 and 267 during operation of the compressor. As shown in FIGS. 2 and 3, holes 266 and 267 communicate between fluid pockets $S_1$, $S_2$ and second suction chamber 322.

Hole 266 is placed at a position defined by involute angle $\phi_1$ and opens along the inner side wall of spiral element 262. Hole 267 is placed at a position defined by involute angle $\phi_1-\pi$ and opens along the outer side wall of spiral element 262. The preferred area in which to place holes 266 and 267, as defined by the involute angles, is given by $\phi end > \phi_1 > \phi end - 2\pi$ wherein $\phi end$ is the final involute angle of each of spiral elements 262 and 272.

Holes 266 and 267 are formed by drilling into circular end plate 261 from the side opposite from which spiral element 262 extends. Hole 266 is drilled at a position which overlaps with the inner wall of spiral element 262 so that a portion of the inner wall is removed. Hole 267 is drilled at a position which overlaps with the outer wall of spiral element 262 so that a portion of the outer wall of spiral element 262 is removed. In this arrangement, the axial end surface of each spiral element is provided with a seal which forms an axial seal between the spiral element and the facing end plate. Hole 266 and 267 are positioned so that they do not connect with the fluid pockets between spiral elements 262 and 272 when spiral element 272 completely overlaps the holes. This is accomplished by extending a portion of each hole into spiral element 262 which results in the seal element in spiral element 272 remaining completely in contact with end plate 261 when spiral element 272 completely overlaps the holes.

With reference to FIGS. 2 and 3, the operation of the mechanism for changing the capacity or displacement volume of the fluid pockets, i.e., the volume of the sealed off fluid pockets at the time compression begins, will be described. During the operation of compressor 1, if first suction chamber 321 is connected to suction line 36 of the external fluid circuit through first inlet port 33 by operation of three-way valve device 37 and communication between second suction chamber 322 and suction line 36 of the external fluid circuit is closed, fluid which flows into front chamber 31 through first suction chamber 321 is taken into the fluid pockets $S_1$ and $S_2$. Pockets $S_1$ and $S_2$ are formed at the most outward portion of spiral elements 262 and 272 as shown in FIG. 2. As orbiting scroll 27 orbits, the fluid in fluid pockets $S_1$ and $S_2$ moves to the center of the spiral elements and is discharged into discharge chamber 323 through discharge hole 264. The volume of fluid pockets $S_1$ and $S_2$ is defined by the line contacts of the outer terminal end of each spiral element.

When second suction chamber 322 is connected to suction line 36 of the external fluid circuit through second inlet port 34 by operation of three-way valve device 37 and communication between first suction chamber 321 and suction line 36 of the external fluid circuit is closed, fluid in second suction chamber 322 is introduced through holes 266 and 267 into fluid pockets $S_1$ and $S_2$ even if the internal end portion of each spiral element is in contact with the side wall of its opposed spiral element to form the sealed off fluid pockets Fluid pockets $S_1'$ and $S_2'$ are then formed after spiral element 272 crosses over holes 266 and 267 as shown in FIG. 3. The volume of fluid pockets $S_1'$ and $S_2'$ at the time when the pockets are sealed from second suction chamber 322 (and compression actually begins) is reduced. Therefore, the capacity of the compressor is reduced.

In the embodiment shown in FIG. 1, three-way valve device 37 is located on the outer portion of compressor 1. Alternatively, three-way valve device 37 may be formed integral to compressor 1.

As mentioned above, the circular end plate of the fixed scroll has a suction hole formed at an outer peripheral portion thereof for connecting the suction chamber to the first inlet chamber and one pair of holes for connecting the suction chamber to a second inlet chamber. Communication between the first inlet chamber and fluid circuit or second inlet chamber and fluid circuit is controlled by valve means. Therefore, fluid can be taken into the sealed off fluid pockets without a reduction in efficiency.

This invention has been described in detail in connection with a preferred embodiment. This embodiment, however, is merely for example only and this invention is not restricted thereto. It will be easily understood by those skilled in the art that other variations and modifications can be easily made within the scope of this invention as defined by the appended claims.

We claim:

1. In a scroll type fluid compressor including a pair of scrolls each having a circular end plate and a wrap extending from one end surface of said circular end plate, said wraps interfitting at angular and radial offset to make a plurality of line contacts to define at least one pair of sealed off fluid pockets, a driving mechanism operatively connected to one of said scrolls to effect the orbital motion of said one scroll and rotation preventing means for preventing the rotation of said one scroll during orbital motion to thereby change the volume of the fluid pockets, the improvement comprising:

a suction hole formed through said circular end plate of a selected scroll of said pair of scrolls to form a first fluid communication channel between said fluid pockets and a first fluid inlet port;

first and second holes formed through said circular end plate of said selected scroll to form a second fluid communication channel between said fluid pockets and a second fluid inlet port, said second fluid communication channel being formed when the volume of said fluid pockets is less than the volume of said fluid pockets when said first fluid communication channel is formed; and valve means for changing the displacement capacity of said compressor by selectively controlling the opening and closing of said first and second fluid inlet ports.

2. In a scroll type fluid compressor including a housing, a first fluid inlet port, a second fluid inlet port, a fluid outlet port, a scroll fixedly disposed within said housing and having a circular end plate from which a first wrap extends into the interior of said housing, an orbiting scroll having a circular end plate from which a second wrap extends, said first and second wraps interfitting at angular and radial offsets to form a plurality of line contacts to define at least one pair of sealed off fluid pockets, a drive shaft, a driving mechanism operatively connected to said orbiting scroll to effect the orbital motion of said orbiting scroll by rotation of said drive shaft and rotation preventing means for preventing the rotation of said orbiting scroll during orbital motion to thereby change the volume of said fluid pockets, the improvements comprising:

said circular end plate of said fixed scroll partitioning the interior of said housing into a first chamber in which said first wrap extends and a second chamber;

at least one partition wall disposed within said second chamber to provide a discharge chamber, a first suction chamber and a second suction chamber;

a hole formed through said circular end plate of said fixed scroll to form a first fluid communication channel between said fluid pockets and said first inlet port through said first suction chamber;

first and second holes formed through said circular end plate of said fixed scroll to form a second fluid communication channel between said fluid pockets and said second inlet port, said second fluid communication channel being formed when the volume of said fluid pockets is less than the volume of said fluid pockets when said first fluid communication channel is formed; and valve means for changing the displacement capacity of said compressor by selectively controlling the communication between an external fluid circuit and said first and second fluid inlet ports.

3. In a scroll type fluid compressor including a pair of scrolls each having a circular end plate and a wrap extending from one end surface of said circular end plate, said wraps interfitting an angular and radial offset to make a plurality of line contacts to define at least one pair of sealed off fluid pockets, a driving mechanism operatively connected to one of said scrolls to effect the orbital motion of said one scroll and rotation preventing means for preventing the rotation of said one scroll during orbital motion to thereby change the volume of the fluid pockets, the improvement comprising:

a suction hole formed through said circular end plate of a selected scroll of said pair of scrolls to form a first fluid communication channel between said fluid pockets and a first fluid inlet port;

first and second holes formed through said circular end plate of said selected scroll to form a second fluid communication channel between said fluid pockets and a second fluid inlet port, said second fluid communication channel being formed when the volume of said fluid pocket is less than the volume of said fluid pockets when said first fluid communication channel is formed, said first and second holes being located at symmetrical locations along said wrap so that said facing wrap simultaneously crosses over said first and second holes during the operation of said compressor, said first hole being formed at a position which overlaps with the inner wall of said wrap which extends from said selected scroll so that a portion of said inner wall is removed and said second hole being formed at a position which overlaps with the outer wall of said wrap which extends from said selected scroll so that a portion of said outer wall is removed; and valve means for changing the displacement capacity of said compressor by selectively controlling the opening and closing of said first and second fluid inlet ports.

4. The scroll type fluid compressor of claim 3 further comprising a discharge hole formed through said selected scroll to form a third fluid communication channel between said fluid pockets and a discharge chamber in said compressor.

5. The scroll type fluid compressor of claim 3 wherein one hole of said pair of second holes is placed at a position defined by involute angle $\phi_1$ and the other hole of said pair of second holes is placed at a position defind by involute angle $\phi_1-\pi$.

6. The scroll type fluid compressor of claim 3 wherein said pair of second holes is placed in an area defined by the involute angles $\phi\text{end}>\phi_1>\phi\text{end}-2\pi$, were $\phi$end is the final involute angle of said wraps.

7. The scroll type fluid compressor of claim 3 wherein said valve means comprises a three-way valve device.

8. In a scroll type fluid compressor including a housing, a first fluid inlet port, a second fluid inlet port, a fluid outlet port, a scroll fixedly disposed within said housing and having a circular end plate from which a first wrap extends into the interior of said housing, an orbiting scroll having a circular end plate from which a second wrap extends, said first and second wraps interfitting at angular and radial offsets to form a plurality of line contacts to define at least one pair of sealed off fluid pockets, a drive shaft, a driving mechanism operatively connected to said orbiting scroll to effect the orbital motion of said orbiting scroll by rotation of said drive shaft and rotation preventing means for preventing the rotation of said orbiting scroll during orbital motion to thereby change the volume of said fluid pockets, the improvement comprising:

said circular end plate of said fixed scroll partitioning the interior of said housing into a first chamber in which said first wrap extends and a second chamber;

at least one partition wall disposed within said second chamber to provide a discharge chamber, a first suction chamber and a second suction chamber;

a hole formed through said circular end plate of said fixed scroll to form a first fluid communication channel between said fluid pockets and said first inlet port through said first suction chamber;

first and second holes formed through said circular end plate of said fixed scroll to form a second fluid communication channel between said fluid pockets and said second inlet port, said second fluid communication channel being formed when the volume of said fluid pockets is less than the volume of said fluid pockets when said first fluid communication channel is formed, said first and second holes being located at symmetrical locations along said first wrap so that during the operation of said compressor said second wrap simultaneously crosses over both of said first and second holes, said first hole being formed at a position which overlaps with the inner wall of said wrap which extends from said selected scroll so that a portion of said inner wall is removed and said second hole being formed at a position which overlaps with the outer wall of said wrap which extends from said selected scroll so that a portion of said outer wall is removed; and valve means for changing the displacement capacity of said compressor by selectively controlling the communication between an external fluid circuit and said first and second fluid inlet ports.

9. The scroll type fluid compressor of claim 8 wherein said valve means comprises a three-way valve device.

* * * * *